US011772939B2

(12) United States Patent
Gardiner

(10) Patent No.: US 11,772,939 B2
(45) Date of Patent: Oct. 3, 2023

(54) STABLE LIFTING HOOK

(71) Applicant: Equipment Corporation of America, Coraopolis, PA (US)

(72) Inventor: Clarence E. Gardiner, Woodstown, NJ (US)

(73) Assignee: Equipment Corporation of America, Coraopolis, PA (US)

( * ) Notice: Subject to any disclaimer, the term of this patent is extended or adjusted under 35 U.S.C. 154(b) by 0 days.

(21) Appl. No.: 17/076,225

(22) Filed: Oct. 21, 2020

(65) Prior Publication Data

US 2022/0119227 A1 Apr. 21, 2022

(51) Int. Cl.
*B66C 1/34* (2006.01)
*B66C 1/66* (2006.01)

(52) U.S. Cl.
CPC . *B66C 1/34* (2013.01); *B66C 1/66* (2013.01)

(58) Field of Classification Search
CPC ..... B66C 1/34
USPC ..... 294/82.1, 82.13
See application file for complete search history.

(56) References Cited

U.S. PATENT DOCUMENTS 1,449,975 A * 3/1923 Decker ..... E04H 17/266 294/82.1
1,746,707 A * 2/1930 Mallory ..... B66C 1/14 294/82.1
1,798,001 A * 3/1931 Seckler ..... E21B 19/04 294/82.1
2,333,925 A * 11/1943 Grossett ..... B22D 31/00 294/82.23
2,646,306 A * 7/1953 Ferdinand ..... B66C 1/34 24/698.1
2,801,128 A * 7/1957 Washabaugh ..... B66C 1/24 294/67.2
3,450,428 A * 6/1969 Zimmermann ..... B66C 13/00 294/82.1
4,171,842 A * 10/1979 Tolle ..... B66C 1/34 294/82.1
4,736,976 A * 4/1988 Berzenye ..... B66C 1/14 294/81.56
6,609,742 B1 * 8/2003 Macom ..... B66C 1/422 294/104
8,746,640 B2 * 6/2014 Broadley ..... F16M 13/02 248/220.21
2004/0217610 A1 * 11/2004 Hollman ..... B66C 1/22 294/67.22

FOREIGN PATENT DOCUMENTS

CN 201071249 Y 6/2008
CN 202848874 U 4/2013
(Continued)

OTHER PUBLICATIONS

United Kingdom Intellectual Property Office Search Report, dated Apr. 13, 2022, Application GB2115148 5.

*Primary Examiner* — Dean J Kramer
(74) *Attorney, Agent, or Firm* — Paul D. Bangor, Jr., Esquire; Clark Hill PLC

(57) ABSTRACT

A lifting hook, comprising a linear mid-section; a first curved section extending from the mid-section and ending in a generally flat distal end or toe for inserting into an aperture in a drill casing; and a second curved section extending from the mid-section opposite the first curved section and having a flattened distal end defining an eye or hole.

17 Claims, 6 Drawing Sheets

(56) References Cited

FOREIGN PATENT DOCUMENTS

| | | | | | |
|---|---|---|---|---|---|
| CN | 202864681 | U | * | 4/2013 | |
| CN | 202864681 | U | | 4/2013 | |
| CN | 206972475 | U | | 1/2018 | |
| CN | 207061647 | U | | 3/2018 | |
| CN | 208054723 | U | | 11/2018 | |
| CN | 211619764 | U | | 10/2020 | |
| DE | 102021127427 | A1 | | 4/2022 | |
| EP | 2712835 | A1 | * | 4/2014 | ..... B66C 1/22 |
| GB | 2602192 | | | 6/2022 | |

* cited by examiner

STABLE LIFTING HOOK

FIELD OF THE DISCLOSURE

The present disclosure is related to the field of drill casing handling devices, and more specifically to a stable lifting hook for use in conveniently and safely transporting, loading and off-loading drill casings and other pipes or tubes having bolt holes on each end.

BACKGROUND

Various lifting hook devices such as C-hooks, L-hooks, steel handling shoes, pipe lifting shoes, pipe handlers and the like, are known to the prior art for a large variety of uses including for use in hooking hoist cables of cranes and other lifting devices onto pipes and drill casings to allow for the lifting, transportation and placement thereof.

The lifting hook devices known to the prior art offer a wide range of characteristics in terms of strength, durability, ease of use, material cost, etc. There nonetheless remains room for improvement.

The present disclosure expounds upon this background.

BRIEF SUMMARY OF THE DISCLOSURE

Many other variations are possible with the present disclosure, and those and other teachings, variations, and advantages of the present disclosure will become apparent from the description and figures of the disclosure.

One aspect of a preferred embodiment of the present disclosure comprises a lifting hook, comprising: a linear mid-section; a first curved section extending from the mid-section and ending in a generally flat distal end or toe for inserting into an aperture in a pile foundation casing; and a second curved section extending from the mid-section opposite the first curved section and having a flattened distal end defining an eye or hole.

In another aspect of a preferred lifting hook of the present disclosure, each of the mid-section and first and second curved sections have a round cross-section.

In yet another aspect of a preferred lifting hook of the present disclosure, each of the mid-section and first and second curved sections have a round cross-section of about a 2.25 inch diameter.

In another aspect, a lifting hook of the present disclosure further comprises a handle mounted to or integral with the mid-section.

In yet another aspect of a preferred lifting hook of the present disclosure, the first curved section defines a first radius of curvature, R1 of about 0.875 inches to 1 inch.

In another aspect of a preferred lifting hook of the present disclosure, each of the mid-section and first and second curved sections have a round cross-section of about 2 inches in diameter.

In yet another aspect of a preferred lifting hook of the present disclosure, the eye is sized for and capable of receiving a bolt type anchor shackle or a 4¾ ton shackle. In yet a further aspect of a preferred lifting hook of the present disclosure, the toe has a beveled inner edge.

In yet another aspect of a preferred lifting hook of the present disclosure, an inner side of the first curved section defines a first shaved or indented section.

In another aspect of a preferred lifting hook of the present disclosure, an angle between a longitudinal center line of the linear mid-section and a longitudinal center line of the second curved section ranges between 150° and 153°.

Another aspect of a preferred embodiment of the present disclosure comprises a lifting hook, comprising: a linear mid-section having a round cross-section and a handle mounted to or integral with the mid-section; a first curved section having a round cross-section extending from the mid-section and having a flat distal end or toe for inserting into an aperture in a drill casing; a second curved section having a round cross-section extending from the mid-section opposite the first curved section and having a flattened distal end defining an eye or hole; and wherein the first curved section defines a first radius of curvature, R1.

In another aspect of a preferred lifting hook of the present disclosure, R1 is about 0.875 inches to 1 inch.

In yet another aspect of a preferred lifting hook of the present disclosure, the toe has a beveled inner edge.

In yet another aspect of a preferred lifting hook of the present disclosure, an inner side of the first curved section defines a first shaved or indented section.

In another aspect of a preferred lifting hook of the present disclosure, an angle between a longitudinal center line of the linear mid-section and a longitudinal center line of the second curved section ranges between 150° and 153°.

In yet another aspect of a preferred lifting hook of the present disclosure, the round cross-section of each of the mid-section and first and second curved sections has a diameter of about 2 inches to about 2.25 inches.

Yet another aspect of a preferred embodiment of the present disclosure comprises a lifting hook, comprising: a linear mid-section having a round cross-section and a handle mounted to or integral with the mid-section; a first curved section having a round cross-section extending from the mid-section and having a flat distal end or toe for inserting into an aperture in a drill casing, wherein the toe has a beveled inner edge, wherein an outer surface of the first curved section defines a groove; a second curved section having a round cross-section extending from the mid-section opposite the first curved section and having a flattened distal end defining an eye or hole, wherein an angle between a longitudinal center line of the linear mid-section and a longitudinal center line of the second curved section ranges between 150° and 153°; and wherein the first curved section defines a first radius of curvature, R1, of about 0.875 inches to 1 inch.

In another aspect of a preferred lifting hook of the present disclosure, the round cross-section of each of the mid-section and first and second curved sections has a diameter of about 2 inches to about 2.25 inches.

In yet another aspect of a preferred lifting hook of the present disclosure, the handle and mid-section define a square or rectangular opening.

BRIEF DESCRIPTION OF THE DRAWINGS

The present disclosure is illustrated by way of example and not limitation in the figures of the accompanying drawings, in which.

DETAILED DESCRIPTION OF PREFERRED EMBODIMENTS

The following description, taken in conjunction with the referenced drawings, is presented to enable one of ordinary skill in the art to make and use the disclosure and to incorporate it in the context of particular applications. Various modifications, as well as a variety of uses in different applications, will be readily apparent to those skilled in the art, and the general principles, defined herein, may be applied to a wide range of aspects. The present disclosure is not intended to be limited to the aspects disclosed herein. Instead, it is to be afforded the widest scope consistent with the disclosed aspects.

Figure 9:
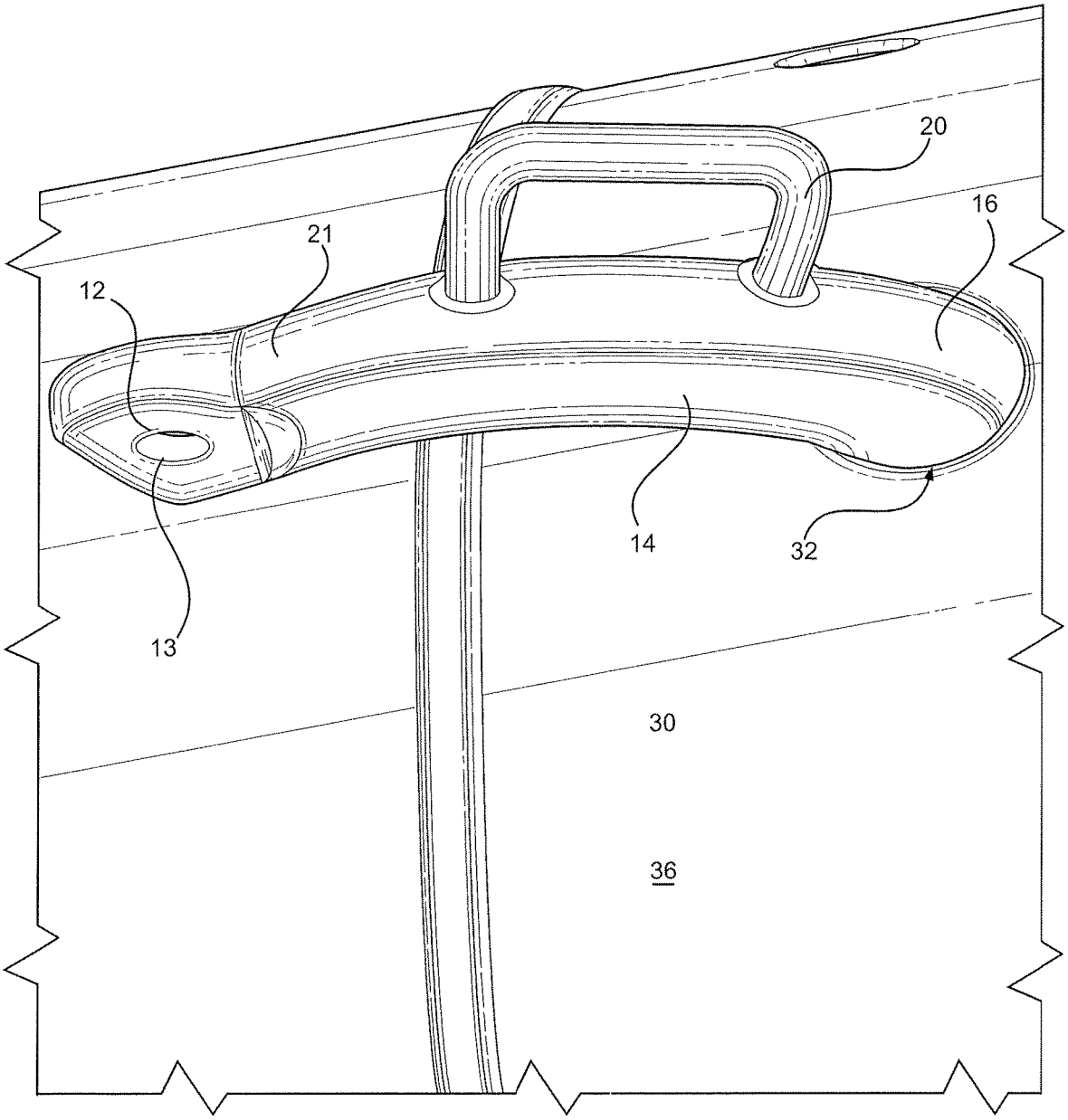
FIG. 9 is a view of the preferred stable lifting hook of FIG. 1 installed in a casing bolt hole of a foundation drill casing.

As shown in FIGS. 1-7, the stable lifting hook 10 of the present disclosure preferably comprises a hybrid between a C-shaped and L-shaped lifting bar/hook having (i) a linear mid-section 14 of generally round cross-section of about 2 inches to about 2.25 inches in diameter with a handle 20 mounted thereto; (ii) a first curved section 16 of generally round cross-section of about 2 inches to about 2.25 inches in diameter extending from the mid-section 14 and ending in a generally flat distal end or toe 22 with a beveled inner edge 17 for ease of inserting into an aperture such as a casing bolt hole 32 near an end of a foundation drill casing 30 (as shown in FIG. 9); (iii) a radius of curvature R1 defined between the first curved section 16 and the mid-section 14 wherein the radius of curvature R1 is preferably about 0.875 inches to about 1 inch; (iv) a second curved section 21 of generally round cross-section of about 2 inches to about 2.25 inches in diameter extending from the mid-section 14 opposite the first curved section 16 wherein the angle 23 between a longitudinal center line 14A of mid-section 14 and a longitudinal center line 21A of second curved section 21 preferably 1 anges between 150° and 153° and more preferably is about 152° and (v) a flattened distal end 12 of the second curved section 21 defining an eye or hole 13 for receiving a bolt type anchor shackle. Preferably, eye 13 is sized for and capable of receiving 4 ¾ ton shackle. Second curved section 21 helps stable lifting hook 10 to swivel and stay balanced during use. Preferably, handle 20 is integral with or attached to mid-section 14 and defines a square or rectangular opening 38.

Figure 1:
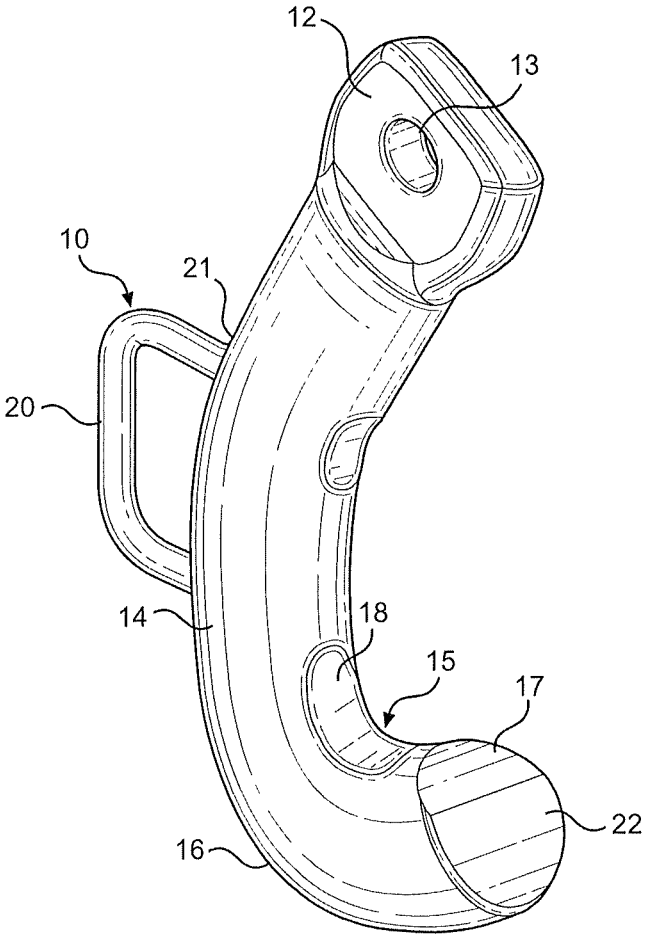
FIG. 1 is a front, top perspective view of a preferred stable lifting hook of the present disclosure.
Figure 2:
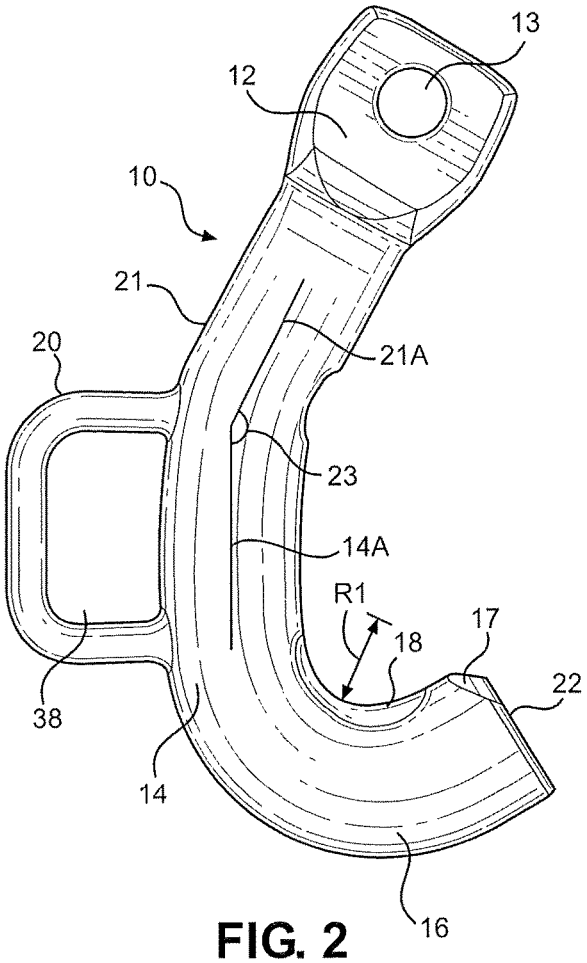
FIG. 2 is a front elevation view of the preferred stable lifting hook of FIG. 1.
Figure 3:
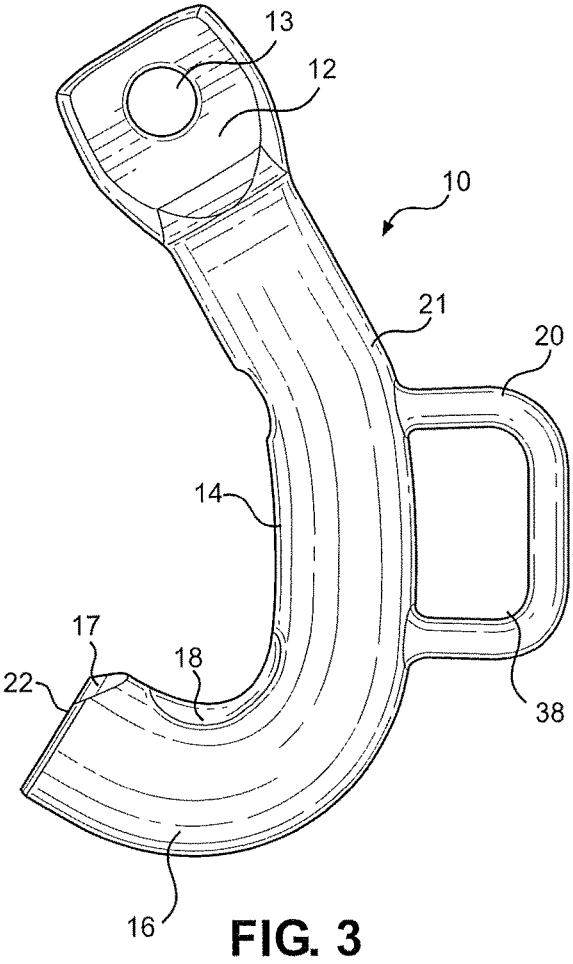
FIG. 3 is a rear elevation view of the preferred stable lifting hook of FIG. 1.
Figure 4:
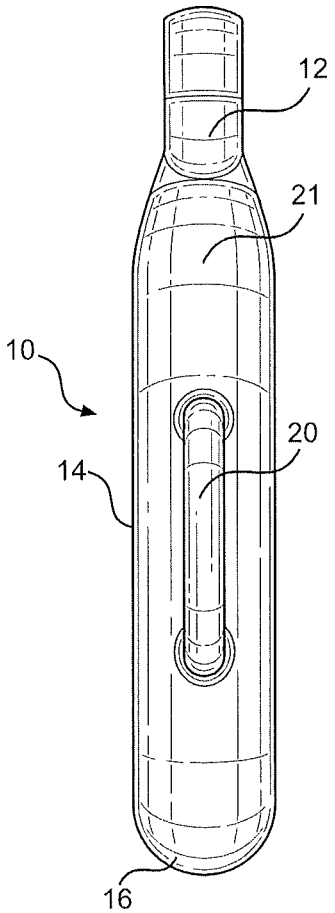
FIG. 4 is a right elevation view of the preferred stable lifting hook of FIG. 1.
Figure 5:
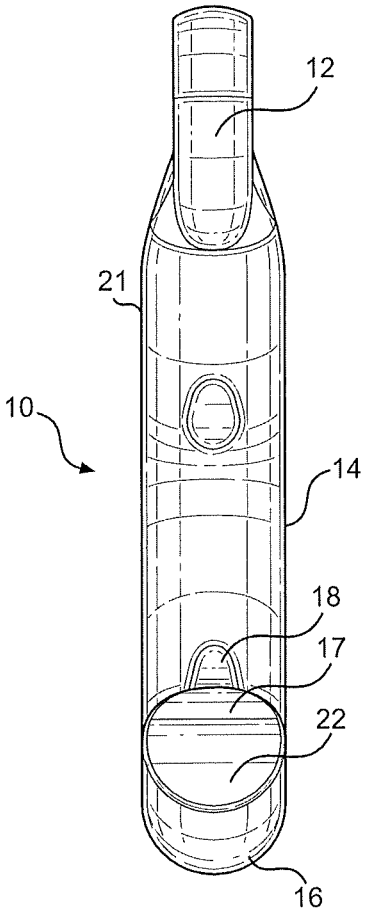
FIG. 5 is a left elevation view of the preferred stable lifting hook of FIG. 1.
Figure 6:
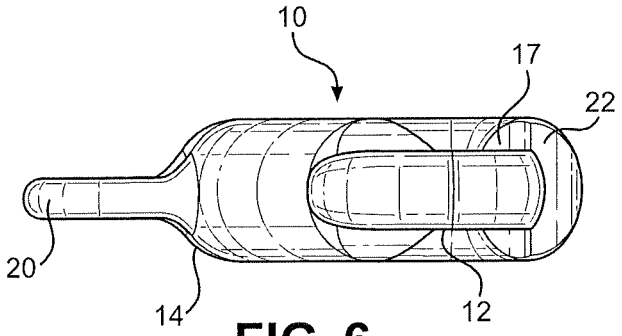
FIG. 6 is a top plan view of the preferred stable lifting hook of FIG. 1.
Figure 7:
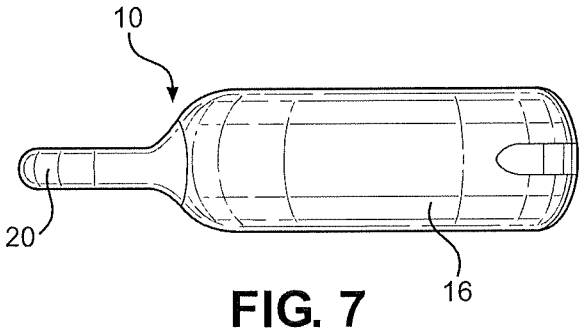
FIG. 7 is a bottom plan view of the preferred stable lifting hook of FIG. 1.
Figure 8:
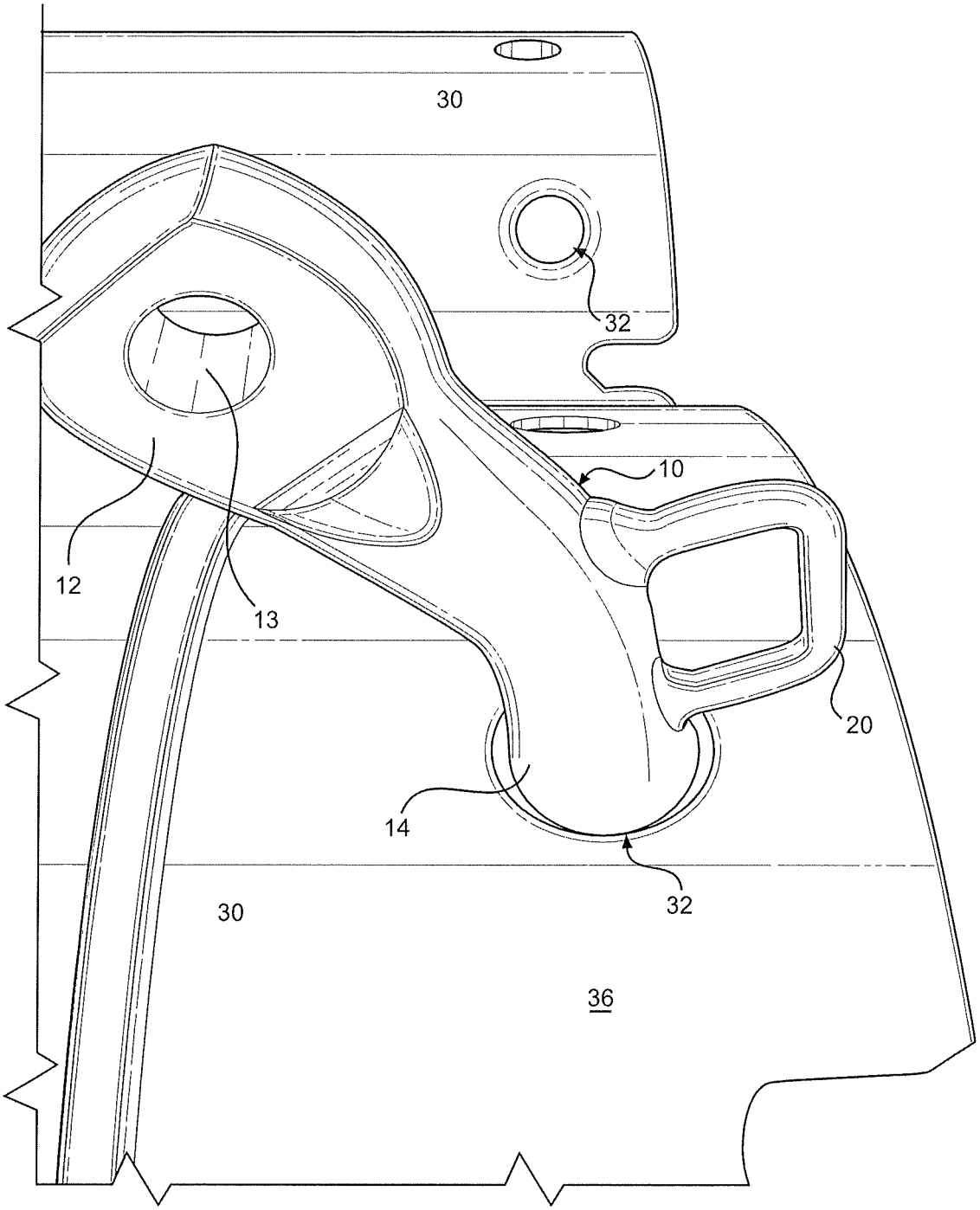
FIG. 8 is a view of the preferred stable lifting hook of FIG. 1 in the process of being inserted into a casing bolt hole of a foundation drill casing.

Preferably, when two stable lifting hooks 10 of the present disclosure are used with a double hoist line sling or the like to lift drill casing 30, with one stable lifting hook 10 inserted into casing bolt hole 32 on each end of drill casing 30, each hoist line (of various types of riggings) under tension is preferably oriented at a 45° with respect to an outer surface 36 of the drill casing 30. The construction of stable lifting hook 10, including first and second curved sections 16 and 21, respectively, enables each hoist line under tension to be oriented at a 45° angle with respect to an outer surface 36 of the drill casing 30. As shown in FIGS. 2-3 and 7, shaved or indented section 18 on the inner side of first curved section 16 and beveled inner edge 17 allow stable lifting hook 10 to be securely seated within installation casing bolt hole 32 without damaging any threads thereof and also helps to enable each hoist line under tension to be oriented at a 45° angle with respect to an outer surface 36 of the drill casing 30. Shaved or indented section 18 on the inner side of first curved section 16 functions to provide clearance for the insertion of the first curved section 16 into casing bolt hole 32 and to achieve the 45° of each hoist line (of various types of riggings) under tension with respect to an outer surface 36 of the drill casing 30.

Preferably, the shape of stable lifting hook 10 and specifically the overall diameter of the first curved section 16 with beveled inner edge 17 and shaved or indented section 18 provide for a releasably locking fit of stable lifting hook 10 within casing bolt hole 32 without causing damage to connection threads defined by the inside surface of casing bolt hole 32. Once stable lifting hook 10 has been inserted into casing bolt hole 32 according to the procedure described herein, it does not have to be held in place and will not fall out of casing bolt hole 32.

Preferably, grip handle 20 keep hands and fingers away from pinch points and is designed for tag line attachment. Preferably, each stable lifting hook 10 has a 3-ton capacity so that a pair can handle lifting up to a 6-ton pile casing 30.

Installation of a stable lifting hook 10 of the present disclosure into a casing bolt hole 32 of pile casing 30 is preferably achieved by first orienting the longitudinal axis 14A of mid-section 14 90° to the longitudinal axis of casing 30. The stable lifting hook 10 is then laid down to follow the contour of the casing 30 and inserted into the casing bolt hole 32 to complete the installation of stable lifting hook 10 into casing bolt hole 32.

The stable lifting hooks 10 are designed to pick up casing 30 horizontally, not vertically. Stable lifting hook 10 can be installed at 4 o'clock or 8 o'clock on the end circumference of casing 30 and does not need to be at 12 o'clock every time because stable lifting hook 10 allows casing 30 to roll up to 12 o'clock without stable lifting hook 10 falling off of casing 30. This all happens because of the cross-sectional diameter and shape of stable lifting hook 10 plus the balance between flattened distal end 12 and toe 22.

It should be understood that while the present disclosure has been described herein in terms of specific embodiments set forth in detail, such embodiments are presented by way of illustration of the general principles of the present disclosure, and the present disclosure is not necessarily limited thereto. Certain modifications and variations in any given material, process step or chemical formula will be readily apparent to those skilled in the art without departing from the true spirit and scope of the present disclosure, and all such modifications and variations should be considered within the scope of the claims that follow.

What is claimed is:

1. A lifting hook for lifting a drill casing, pipe or tube by engaging an opening in an outer surface of the drill casing, pipe or tube, comprising:

a linear mid-section having a round cross-section;

a handle mounted to or integral with the mid-section;

a first curved section having a round cross-section curving continuously throughout its cross-section as the first curved section extends from the mid-section such that an inner curved side of the first curved section faces the drill casing, pipe or tube and wherein the first curved section ends in a generally flat distal end or toe for inserting into an aperture in the casing, pipe or tube; and a second curved section having a round cross-section curving continuously throughout its cross-section as the second curved section extends from the mid-section opposite the first curved section; wherein an angle between a longitudinal center line of the linear mid-section and a longitudinal center line of the second curved section is about 150° and wherein the second curved section has a flattened distal end defining an eye or hole.

2. The lifting hook of claim 1, wherein each of the mid-section and first and second curved sections have a round cross-section of about a 2.25 inch diameter.

3. The lifting book of claim 1, wherein the inner curved side of the first curved section defines a first radius of curvature, R1 of about 0.875 inches to 1 inch.

4. The lifting hook of claim 1, wherein each of the mid-section and first and second curved sections have a round cross-section of about 2 inches in diameter.

5. The lifting hook of claim 1, wherein the eye is sized for and capable of receiving a bolt type anchor shackle or a 4 ¾ ton shackle.

6. The lifting hook of claim 1, wherein the toe has a beveled inner edge.

7. The lifting hook of claim 1, wherein the angle between the longitudinal center line of the linear mid-section and the longitudinal center line of the second curved section ranges between 150° and 153°.

8. The lifting hook of claim 1, wherein the handle and mid-section define a square or rectangular opening.

9. A lifting hook for lifting a drill casing, pipe or tube by engaging an opening in an outer surface of the drill casing, pipe or tube, comprising:

a linear mid-section having a round cross-section;

a first curved section having a round cross-section curving continuously throughout its cross-section as the first curved section extends from the mid-section such that an inner curved side of the first curved section faces the drill casing pipe or tube and wherein the first curved section ends in a generally flat distal end or toe for inserting into an aperture in the casing pipe or tube, wherein an inner side of the first curved section defines a first shaved or indented section; and a second curved section having a round cross-section curving continuously throughout its cross-section as the second curved section extends from the mid-section opposite the first curved section; wherein an angle between a longitudinal center line of the linear mid-section and a longitudinal center line of the second curved section is about 150° and wherein the second curved section has a flattened distal end defining an eye or hole.

10. A lifting hook for lifting a drill casing, pipe or tube by engaging an opening in an outer surface of the drill casing, pipe or tube, comprising:

a linear mid-section having a round cross-section and a handle mounted to or integral with the mid-section;

a first curved section having a round cross-section curving continuously throughout its cross-section as the first curved section extends from the mid-section such that an inner curved side of the first curved section faces the drill casing, pipe or tube and wherein the first curved section ends in a flat distal end or toe for inserting into an aperture in the casing, pipe or tube;

a second curved section having a round cross-section curving continuously throughout its cross-section as the second curved section extends from the mid-section opposite the first curved section; wherein an angle between a longitudinal center line of the linear mid-section and a longitudinal center line of the second curved section is about 150° and wherein the second curved section has a flattened distal end defining an eye or hole;

wherein the inner curved side of the first curved section defines a first radius of curvature, R1, wherein R1 is about 0.875 inches to 1 inch.

11. The lifting hook of claim 10, wherein the toe has a beveled inner edge.

12. The lifting hook of claim 10, wherein the inner curved side of the first curved section defines a first shaved or indented section.

13. The lifting hook of claim 10, wherein the angle between the longitudinal center line of the linear mid-section and the longitudinal center line of the second curved section ranges between 150° and 153°.

14. The lifting hook of claim 10, wherein the round cross-section of each of the mid-section and first and second curved sections has a diameter of about 2 inches to about 2.25 inches.

15. A lifting hook for lifting a drill casing, pipe or tube by engaging an opening in an outer surface of the drill casing, pipe or tube, comprising:

a linear mid-section having a round cross-section and a handle mounted to or integral with the mid-section;

a first curved section having a round cross-section curving continuously throughout its cross-section as the first curved section extends from the mid-section such that an inner curved side of the first curved section faces the drill casing, pipe or tube and wherein the first curved section ends in a flat distal end or toe for inserting into an aperture in a drill casing, wherein the toe has a beveled inner edge, wherein an outer surface of the inner curved side the first curved section defines a shaved or indented section;

a second curved section having a round cross-section curving continuously throughout its cross-section as the second curved section extends from the mid-section opposite the first curved section and having a flattened distal end defining an eye or hole, wherein an angle between a longitudinal center line of the linear mid-section and a longitudinal center line of the second curved section ranges between 150° and 153°;

wherein the inner curved side of first curved section defines a first radius of curvature, R1, of about 0.875 inches to 1 inch.

16. The lifting hook of claim 15, wherein the round cross-section of each of the mid-section and first and second curved sections has a diameter of about 2 inches to about 2.25 inches.

17. The lifting hook of claim 15, wherein the handle and mid-section define a square or rectangular opening.

* * * * *